US005842518A

United States Patent [19]

Soybel et al.

[11] Patent Number: 5,842,518

[45] Date of Patent: Dec. 1, 1998

[54] METHOD FOR DRILLING A WELL IN UNCONSOLIDATED AND/OR ABNORMALLY PRESSURED FORMATIONS

[76] Inventors: Joshua Richard Soybel, 4119 Kirkwall Ct.; Norman Paul Omsberg, 6006 Gideon Ct., both of Sugar Land, Tex. 77479

[21] Appl. No.: 950,525

[22] Filed: Oct. 14, 1997

[51] Int. Cl.[6] ..... E21B 17/10; E21B 33/138

[52] U.S. Cl. ..... 166/287; 166/241.6; 166/242.1; 166/292; 175/72

[58] Field of Search ..... 166/285, 287, 166/292, 293, 309, 376, 241.6, 242.1; 175/72

[56] References Cited

U.S. PATENT DOCUMENTS

| | | | |
|---|---|---|---|
| 2,080,406 | 5/1937 | Allen | 166/287 |
| 2,258,052 | 10/1941 | Hall | 166/287 X |
| 3,774,683 | 11/1973 | Smith et al. | 166/293 |
| 3,844,351 | 10/1974 | Sutton et al. | 166/293 |
| 3,958,637 | 5/1976 | Cobbs | 166/287 |
| 4,057,108 | 11/1977 | Broussard . | |
| 4,759,408 | 7/1988 | Buchanan | 166/287 X |
| 4,784,223 | 11/1988 | Worrall et al. | 166/287 |
| 4,999,389 | 3/1991 | Ariannejad | 523/440 |
| 5,016,711 | 5/1991 | Cowan . | |
| 5,339,902 | 8/1994 | Harris et al. | 166/293 |
| 5,346,007 | 9/1994 | Dillon et al. | 166/285 X |

OTHER PUBLICATIONS

J.P.M. van Vliet et al "Development and Field Use of Fibre–Containing Cement." Offshore Technology Conference, 27th Annual Conference, Houston TX 1995 discloses a soft centered cement plug as a guide for a pilot mill for drilling out part of a fibre cement layer to leave a relatively thin cement lining at a desired location in a borehole.

*Primary Examiner*—George A. Suchfield
*Attorney, Agent, or Firm*—George E. Bogatie

[57] ABSTRACT

A fiber reinforced cement lining for an unconsolidated or otherwise problematic zone in a wellbore is built up by first under-reaming the section of the wellbore to be stabilized by the cement lining. Next a drillable metallic liner is centralized in the under-reamed section and the annulus formed between the metal liner and the wellbore wall is filled with the fiber cement. After the cement has hardened, the drillable liner and a portion of its surrounding cement are milled out using the drillable liner as a guide for a piloted mill tool, thus leaving a relatively uniform thick-walled cement sheath bridging the zone to be stabilized in the wellbore while restoring the original diameter of the wellbore through the unconsolidated zone.

14 Claims, 2 Drawing Sheets

METHOD FOR DRILLING A WELL IN UNCONSOLIDATED AND/OR ABNORMALLY PRESSURED FORMATIONS

The present invention relates to sealing off a problematic zone during drilling of a well to permit forward drilling below the problematic zone. More particularly this invention relates to a method using specific components and materials for placing a cement lining in a selected portion of a wellbore that traverses a severely unconsolidated or problematic formation.

BACKGROUND OF THE INVENTION

The recovery of fluids, such as gas and/or oil from underground formations, has been found to be troublesome in subterranean zones where the formation is composed of one or more unconsolidated or abnormally pressured layers. Conventionally, aqueous-based drilling fluids containing water, clay and various additives are circulated through the wellbore during the drilling operation to carry drill cuttings from the wellbore to the surface. These clay containing drilling fluids form a mud cake on the wellbore wall which reduces the sloughing of the unconsolidated formation as long as the fluid pressure in the wellbore due to the standing column of drilling fluid, exceeds the pressure of any connate fluid in the unconsolidated formation. Accordingly drilling through certain unconsolidated formations is not a particularly serious problem. It is commonplace, however, to encounter a lost circulation zone in drilling a well, either in a severely unconsolidated formation itself or in an underlying stratum, so as to lose the column of drilling fluid into the earth. This loss of drilling fluid results in a considerable loss of time and a considerable increase in expense.

It is also known in the art that formation stabilization, i.e., prevention of drilling fluid loss, wellbore cave-ins or influx can be effected by installing a solid barrier, such as a casing or liner between the formation to be stabilized and the open end hole. This is conventionally accomplished by setting a long casing string from the surface extending through the formation to be stabilized, or by setting an intermediate size casing in the desired location and then filling a space between the formation wall and the intermediate casing with a hydraulic cement slurry. After the cement hardens, drilling operations can resume. These methods of stabilization, however, require the time and expense of setting the longer casing from the surface or setting the intermediate casing. Further, if a permanent intermediate size casing section is set, reduced hole size results, which is often a disadvantage.

As drilling depth increases, which is common when drilling wells in offshore sub-salt plays, still further problems commonly arise in that adjacent zones of significantly different pressure, and faulted zones are often encountered below the salt layer. In these deep zones, casing shoes, which typically provide integrity for forward drilling from a specific depth, are not effective for their intended purpose, and reinforcement of the "below shoe" well is also required for this reason.

If sub-salt play in the oil industry is to continue to grow, cost reductions are necessary in drilling and completing subsalt wells. Accordingly, an urgent need exists for new and improved methods and materials that reduce the time required for sub-salt well completion.

Accordingly, it is an object of this invention to reduce the time required for drilling and completing subsalt wells.

A more specific object is to seal off a potentially troublesome zone encountered at a location deep in a wellbore so as to provide for forward drilling from a specific depth below the troublesome zone.

Another more specific object is to place a high strength wellbore lining material at a specific location deep in a wellbore to remedy troubles caused by unstable formations.

Another still more specific object of this invention is to place a high strength wellbore lining material across an abnormally pressured zone at a specific location deep in a wellbore.

Yet another object is to eliminate the need for setting a permanent intermediate length casing section in a wellbore to isolate a severely unconsolidated problem zone.

Another more specific object is to provide a drillable metal liner that is useful in a wellbore for problem zone mitigation.

SUMMARY OF THE INVENTION

According to the present invention, the foregoing and other objects and advantages are attained by applying several different techniques and materials to isolate a problem zone that is encountered at a location deep in a wellbore, so that forward drilling progress below the problem zone can be restored. The problem zone, which is typically an unconsolidated and/or abnormally pressured formation, is identified and then conventionally drilled to the desired diameter of the wellbore. Next, according to the invention the problem zone and a slight section both above and below the problem zone is under-reamed, and a drillable metal liner, which is of a much smaller diameter than the wellbore and includes features for centralizing the liner, is positioned to overlap each end the under-reamed section of the wellbore. The drillable liner is centrally positioned in the wellbore using fiberglass bowspring centralizers. A highly resilient fiber reinforced and nitrified cement, which is impermeable to gas and water, is then pumped into the annular cavity between the drillable liner and the wall of the wellbore to seal the wellbore wall by forming a thick walled sheath of impermeable cement around the drillable liner. Using the drillable liner as a guide, a piloted milling assembly is then employed to mill out the drillable liner along with a portion of the surrounding cement sheath to restore the preliner dimensions to the wellbore, while leaving a thick-walled cement sheath to stabilize the problem zone.

The thus provided cement sheath bridging the problem zone is of sufficient thickness to seal off the problem zone from the wellbore. The method and apparatus of this invention, which includes a drillable metal liner centralized in an under-reamed problem zone mostly filled with cement, speeds up a piloted milling operation for restoring the cement filled under-reamed section of the wellbore to preliner dimensions. A metal liner of carbon steel is preferred for use in this invention because of advantages in millibility, hole cleaning, cement bonding and availability in standard well sizes. However, any drillable material, such as fiberglass or aluminum, can be employed depending upon availability and job specifics. The drillable liner is thus used to guide the piloted milling assembly through the problem zone, and further to facilitate providing uniform dimensions for the cement sheath remaining in the wellbore after milling out the drillable liner and a portion of the surrounding cement in the under-reamed section of the wellbore.

Still other objects and advantages of the present invention will become readily apparent to those skilled in this art from the following detailed description, wherein there is shown and described only the preferred embodiment of the invention, simply by way of illustration of the best mode contemplated for carrying out the invention. As will be realized, the invention can be accomplished by other and different embodiments, and its several details can be modified in various obvious respects, all without departing from the present invention. Accordingly, the drawings and description are to be regarded as illustrative in nature, and not as restrictive.

DETAILED DESCRIPTION OF THE PREFERRED EMBODIMENT

Figures 1, 2, 3:
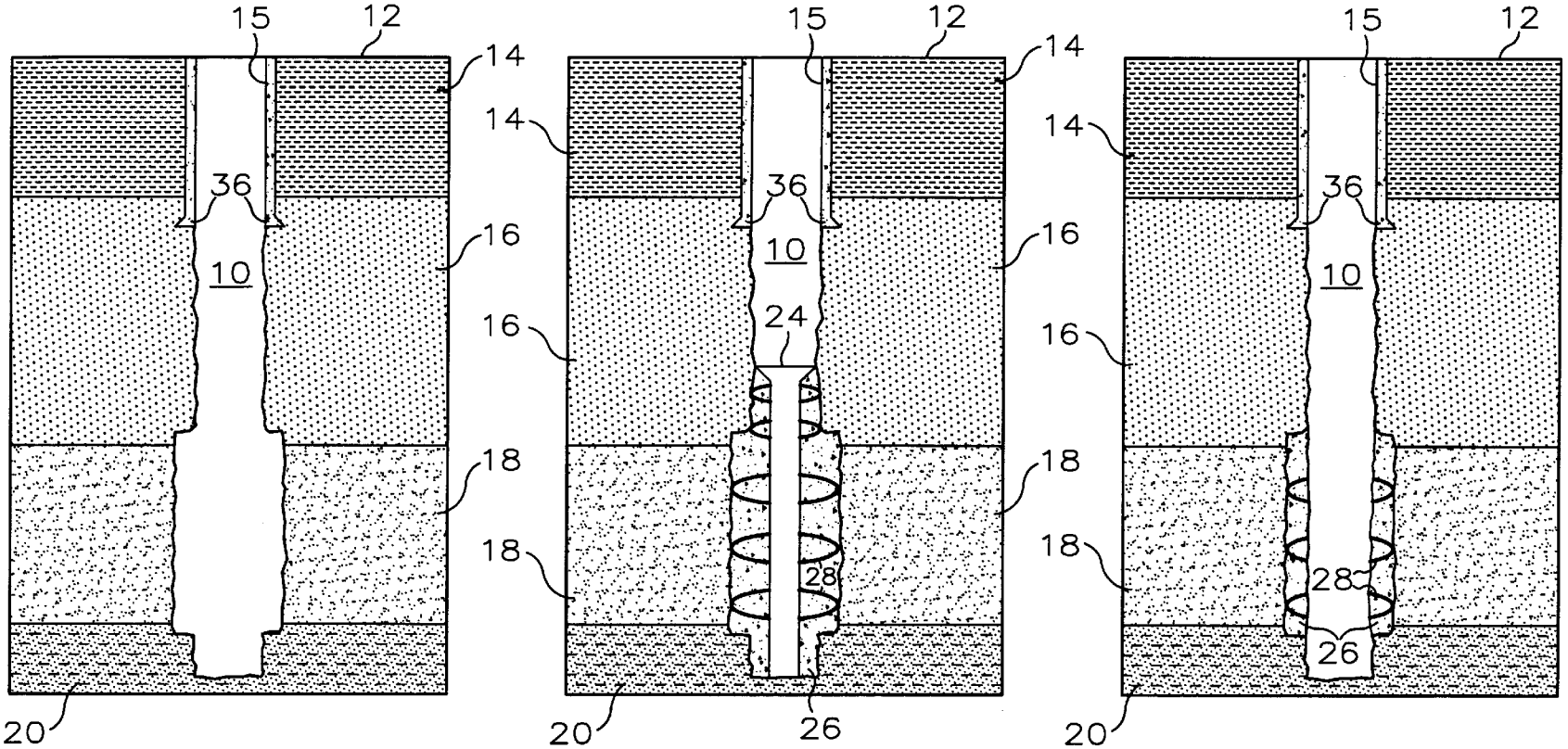
FIG. 1 is a schematic illustration of a conventional casing scheme with an open-hole wellbore extension having an under-reamed section traversing a problem zone.
FIG. 2 is a schematic illustration of a drillable liner surrounded by cement with the liner bridging a severe problem zone according to the present invention.
FIG. 3 is a schematic illustration of a borehole lining that has been applied to seal off a trouble zone according to this invention.

The inventive method preferably utilizes a fiber reinforced foamed cement composition which when set is nonpermeable to oil, gas, other formation fluids, and formation particulates, and which has sufficient tensile strength to resist wear and fragmentation when sideways contacted with a rotating drill string. Nonpermeable foamed cement compositions, which are formed by introducing nitrogen, air or some other gas into a cement slurry, have been used heretofore in oil and gas wells for performing various primary cementing operations. Compared to non-foamed cement compositions, foamed cement compositions typically have low densities, low fluid loss properties and good resilient properties.

Fiber containing cement has also been used heretofore in oil and gas wells as a high strength material that could be used to line a borehole. Being made of an inert material the synthetic fibers do not influence the chemically adjusted properties of a cement slurry, e.g., pumping time, fluid loss etc. The fibers are added to the slurry at the last stage, after it has been mixed to its final chemical composition, and are added in such an amount that they take up about 1.5% of the volume of the fiber containing slurry. Fiber containing cement, which can be mixed and pumped with standard oilfield cementing equipment, has a better tensile strength, ductility and wear resistance than cement without fibers. A suitable fiber reinforced foamed cement is available for example from Halliburton Co. in Dunkin, Okla.

In performing cementing operations with a fiber reinforced foamed cement composition, the cement composition is pumped down a casing disposed in a wellbore such that, when the cement slurry reaches the bottom of the casing, the cement slurry flows upwardly and into the annulus existing between the exterior of the well casing and the earthen wall of the wellbore. Upon setting, the cement bonds to the casing and to the wellbore. Due to its low density, foamed cement compositions can be advantageously used in operations where it is necessary to minimize hydrostatic pressure effects on weak formations.

The inventive method begins with under-reaming a section of the wellbore, where the under-reamed section includes all of the unconsolidated section and extends slightly into competent sections both above and below the unconsolidated section. Preferably the diameter of the under-reamed section is in a range of from about 1.5 to about 1.2 times the diameter of the wellbore.

The invention also uses any suitable metallic material for a drillable liner that is millable by ordinary milling tools, and as previously mentioned includes features directed to centralizing the liner within the under-reamed section of the wellbore. The drillable liner, which is preferably made of carbon steel, is positioned to overlap the under-reamed section of the wellbore and is cemented by conventional methods using fiber reinforced foamed cement. One preferred liner material is N-80 grade steel or equivalent. Another preferred liner material is aluminum, which may be advantageous in terms of material cost, and availability in standard sizes. Yet another preferred drillable liner is a combination steel/aluminum liner, which includes alternate sections of steel and aluminum.

After the cement is set, the liner and a portion of the surrounding cement is milled out to restore preliner diameter to the wellbore. Whatever the material used for the liner, collection of the debris generated in the milling operation is an important consideration, since this debris must be circulated out of the well.

In a particularly successful test of the milling operation according to this invention, it has been found that polymer drilling fluid mud such as FLOZEN™ circulated at an annular velocity of about 30-ft./sec. satisfactorily collected both steel and aluminum cuttings from a 7-inch diameter liner weighing 29-lb./ft. and also from a 9⅝-inch diameter liner weighing 40-lb./ft., as well as debris generated in partially milling up the cement ring surrounding the liner. This was accomplished while drilling a 12½-inch hole at a drilling rate in a range of about 20-ft./hr. to about 40-ft./hr. using conventional piloted mill tools, for example, a Smith "Parahna" mill and a Baker Oil Tool "Metal Muncher". The condition of the remaining cement sheath was determined by logs, sidewall cores, changes in wellbore hydrostatic and video logs. Generally, the cement sheath produced competent sidewall cores.

A preferred embodiment of the method of this invention is illustrated in FIGS. 1 through 4. As shown in these figures, where like reference numerals are used to refer the same elements in each of the figures, a wellbore 10 extends from the surface of the earth 12 through three subterranean formations 14, 16 and 18 and into a fourth subterranean formation 20 located deep in the wellbore 10. As shown formations 14, 16 and 20 are reasonably competent and do not require consolidation. Typically, formation 16 is a durable salt formation. Formation 18, however, is severely unconsolidated and prone to sloughing into the wellbore 10. Below formation 18 is a fluid bearing reservoir 20 such as a reservoir containing oil or gas or other mineral deposit of interest. The objective of the wellbore is to penetrate into formation 20 to tap the fluid contained therein, however, as drilling depth increases so does the complexity of isolating zones of incompetent formations.

Referring specifically now to FIG. 1, there is illustrated the condition of the wellbore 10 after the wellbore has been drilled from the surface into the formation 20, and the problem zone 18 has been under-reamed. The wellbore 10 is drilled and the zone 18 is under-reamed in a conventional manner using a rotating drill string, a bit, circulating drilling fluid, etc., (none of which is illustrated). By way of example, the wellbore 10, as shown in FIG. 1 can include a conventional 13⅝-inch casing section 15 extending from the surface through the formation 14, a 12½-inch hole extending through zone 16, an under-reamed section of 16-inch diameter through the incompetent zone 18, with the 12½-inch hole extending, if possible, about 100-ft. into the production zone 20. The under-reamed zone through section 18 begins slightly above (e.g., 60-ft.) the unconsolidated zone 18, and extends slightly below (e.g., 30-feet) the unconsolidated zone 18, thus providing about a 70-ft. rathole of reduced diameter for setting the drillable liner in the formation 20 below the unconsolidated zone 18.

FIG. 2 illustrates the condition of the wellbore 10 after the drillable liner 24 has been run and cemented in the wellbore 10 using fiber reinforced cement illustrated at 26. Setting and cement 24 of the drillable liner 24 are accomplished using ordinary off-the-shelf tools including shoe joint, float collar joint, landing collar joint, and liner running/releasing tool joints, which are not illustrated but which are familiar to those skilled in the art.

Referring now to FIG. 3, there is illustrated the condition of the wellbore 10 after the liner 24 and a portion of its surrounding cement 26 have been milled out. In the aforementioned test of drilling operations, after the cement 26 was set, the drillable metal liner 24 and a portion of the fiber cement layer 26 were successfully milled out with a 12½-inch pilot mill, using the drillable liner as a guide. With the various diameters of wellbore 10 referenced in the discussion of FIG. 1, the remaining cement sheath 26 in FIG. 3 is about two inches thick and generally cylindrical in shape. However, thicker cement sheaths can be provided if desired.

Figure 4:
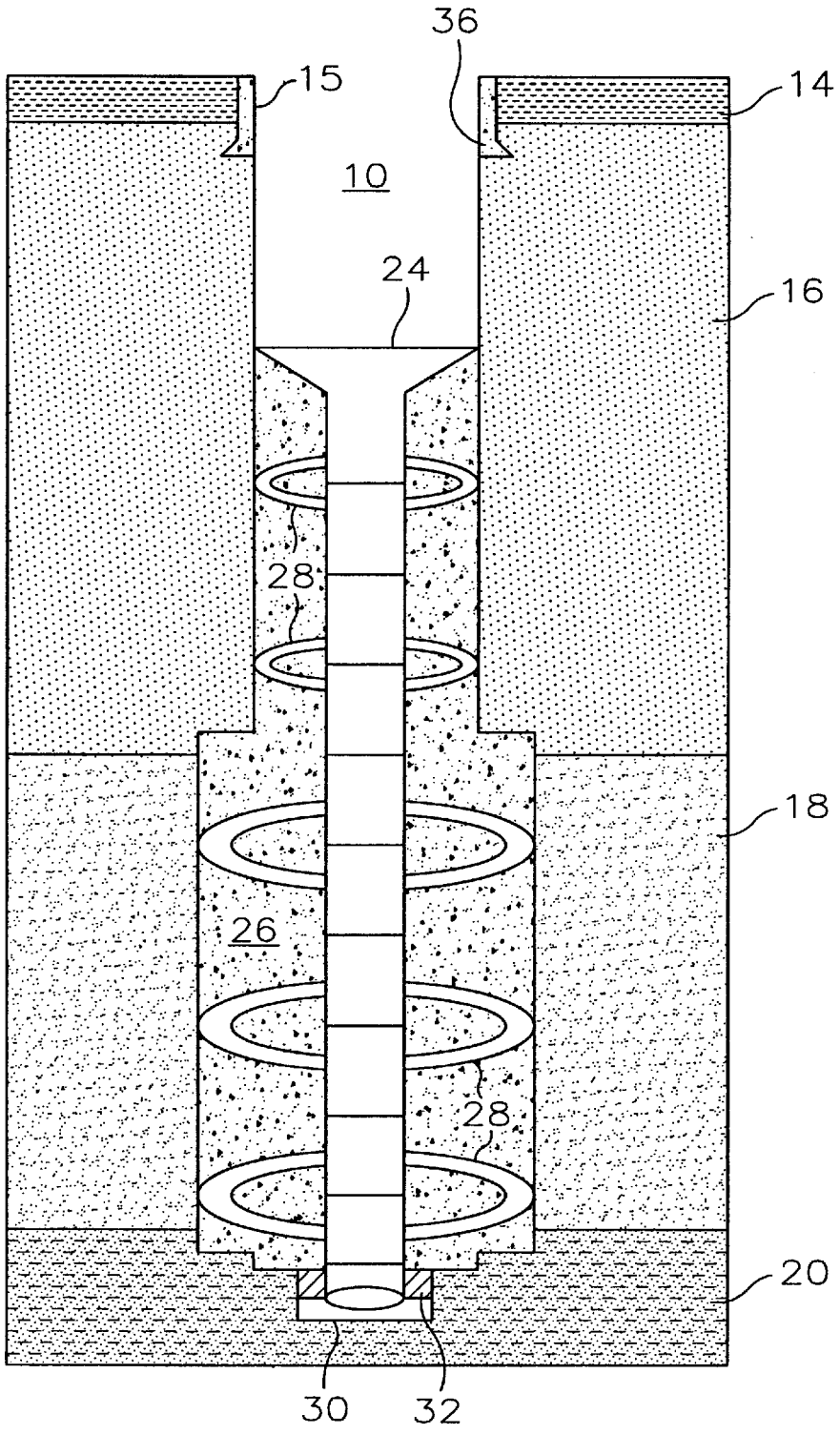
FIG. 4 is a schematic illustrating centralizers applied to the drillable liner according to this invention.

Referring now to FIG. 4, there is illustrated the same condition of wellbore 10 as shown in FIG. 2, where the wellbore is drilled through consolidated layers 14, and 16, then through unconsolidated layer 18 and into the producing layer 20, with the drillable liner 24 surrounded with cement 26. FIG. 4, however, shows greater detail and illustrates features not shown in FIG. 2. In particular the drillable liner 24 can consist of a 7-inch diameter or a 9⅝-inch diameter specialized drillable pipe preferably constructed of alternate sections of steel and aluminum, and fitted with customized bow spring centralizers 28. The fiberglass centralizers allow for good centralization, which is critical to placement of the cement sheath. These centralizers, which are well known to those skilled in the art, also provide good milling characteristics and minimize the transfer of destructive shock loads to the cement sheath when milling the liner as would otherwise be witnessed with standard metal solid-body centralizers. Centralizers made of glass fiber reinforced epoxy are preferred for use in this invention. Also shown in FIG. 4 is a pilot hole 30 in which the lower end of the drillable liner 24 is centered by metal centralizers 32, and in addition a casing shoe 36 is illustrated at the terminal end of the casing 15 extending to the surface.

Accordingly, the present invention is well adapted to achieve the objects and attain advantages for rapidly bridging a problem zone in a sub-salt zone in a wellbore. While presently preferred embodiments have been described for purposes of illustration, numerous changes and modifications will be apparent to those skilled in the art. Such changes and modifications are encompassed within the spirit of this invention as defined by the appended claims.

That which is claimed is:

1. A method of stabilizing an unconsolidated formation traversed by a wellbore to permit forward drilling below said unconsolidated formation, said method comprising:

a) under-reaming a section of said wellbore, wherein said under-reamed section includes all of said unconsolidated formation and extends slightly into formations both above and below said unconsolidated formation;

b) installing in said wellbore a drillable metal liner assembly positioned to traverse said under-reamed section and to extend further into formations both above and below said unconsolidated formation;

c) wherein said drillable liner is centralized in said wellbore and in said under-reamed section of said wellbore, thereby forming an annulus between said drillable liner and the wellbore wall;

d) filling said annulus with a fiber reinforced foamed cement composition and permitting said cement composition to harden in said annulus; and e) milling out said drillable liner and a portion of said fiber-cement composition in said annulus using said drillable metal liner as a guide for a piloted mill tool, thereby leaving a thick-walled cement sheath liner for stabilizing said unconsolidated formation in said wellbore.

2. A method in accordance with claim 1, wherein said under-reamed section of said wellbore has a diameter in a range of about 1.5 to about 1.2 times the diameter of said wellbore.

3. A method in accordance with claim 1, wherein said drillable liner is constructed of carbon steel.

4. A method in accordance with claim 1, additionally comprising constructing said drillable liner as a combination of materials including steel and aluminum arranged in alternate sections.

5. A method in accordance with claim 1, additionally comprising forming a fibers containing cement slurry, wherein fibers are added to the slurry at the last stage after it has been mixed to its final chemical composition and wherein said fibers are added in an amount of about 1.5% of the volume of the fiber containing slurry.

6. A method in accordance with claim 1, wherein said drillable liner has a diameter in a range of about ½ to about ¾ times the diameter of said wellbore.

7. A method in accordance with claim 1, wherein said step of milling out said drillable liner restores the original wellbore diameter through the unconsolidated formation.

8. A method in accordance with claim 1, additionally comprising using bowspring centralizers made of glass fiber reinforced epoxy to centralize said drillable liner in said wellbore, and in said under-reamed section.

9. A method in accordance with claim 1, wherein the extension of said under-reamed section into the formation above said unconsolidated formation is about sixty feet, and the extension into the formation below said unconsolidated formation is about 30 feet.

10. A method in accordance with claim 1, wherein said drillable metal liner extends into the formation below said unconsolidated formation a length of about seventy feet below said under-reamed section.

11. A method in accordance with claim 1, wherein said drillable metal liner and portion of surround cement are milled out at a milling rate in a range of from about 20 ft./sec. to about 40 ft./sec.

12. A method in accordance with claim 1, wherein said cement sheath liner has a thickness in a range of about 1-inch to about 4-inches.

13. A method in accordance with claim 1, wherein said unconsolidated formation is abnormally pressured compared to adjacent formations.

14. A method in accordance with claim 1, wherein said unconsolidated formation is a faulted zone.

* * * * *